US005556205A

United States Patent [19]

Gallie et al.

[11] Patent Number: 5,556,205

[45] Date of Patent: Sep. 17, 1996

[54] FLEXIBLE, INTERMEDIATE BULK CONTAINER

[75] Inventors: Ian G. Gallie, Woodlands; John R. Thorpe, Zinkwazi, both of South Africa

[73] Assignee: Nampak Products Limited, Santon, South Africa

[21] Appl. No.: 361,117

[22] Filed: Dec. 21, 1994

[30] Foreign Application Priority Data

Dec. 27, 1993 [ZA] South Africa ..... 93/9699
Apr. 5, 1994 [ZA] South Africa ..... 94/2364

[51] Int. Cl.[6] ..... B65D 30/08; B65D 30/20; B65D 33/14

[52] U.S. Cl. ..... 383/24; 383/38; 383/105; 383/107; 383/109

[58] Field of Search ..... 383/105, 107, 383/109, 24, 38

[56] References Cited

U.S. PATENT DOCUMENTS

| | | | |
|---|---|---|---|
| 2,426,843 | 9/1947 | Phair et al. | 383/38 |
| 2,805,814 | 9/1957 | Calasibetta et al. | 383/38 |
| 4,010,784 | 3/1977 | Nattrass et al. | 383/24 |
| 4,207,937 | 6/1980 | Sandeman et al. | 383/24 |
| 4,299,324 | 11/1981 | Dickens | 383/38 |
| 4,301,848 | 11/1981 | Beaven et al. | 383/24 |
| 4,696,403 | 9/1987 | Hoover | 383/38 |
| 4,872,766 | 10/1989 | Dancy | 383/38 |
| 5,222,812 | 6/1993 | Cuddy et al. | 383/24 |
| 5,328,267 | 7/1994 | Cuddy et al. | 383/105 |
| 5,407,090 | 4/1995 | Boots | 383/38 |

FOREIGN PATENT DOCUMENTS

| | | | |
|---|---|---|---|
| 441720 | 8/1991 | European Pat. Off. | 383/38 |
| 90/4122 | 6/1989 | Finland . | |
| 91/8966 | 11/1990 | Netherlands . | |
| 91/1560 | 3/1991 | Netherlands . | |
| 93/0173 | 1/1993 | Netherlands . | |
| 90/0001 | 1/1990 | South Africa . | |
| 90/0085 | 2/1990 | South Africa . | |
| 91/0732 | 1/1991 | South Africa . | |
| 91/0962 | 2/1991 | South Africa . | |
| 91/0963 | 2/1991 | South Africa . | |

*Primary Examiner*—Stephen P. Garbe
*Attorney, Agent, or Firm*—Ladas & Parry

[57] ABSTRACT

A flexible intermediate bulk container includes a number of flexible elements sewn to each other along longitudinally extending seams, at least two of the elements being tubular.

11 Claims, 6 Drawing Sheets

FLEXIBLE, INTERMEDIATE BULK CONTAINER

FIELD OF THE INVENTION

THIS INVENTION relates to a flexible, intermediate bulk container.

SUMMARY OF THE INVENTION

According to the invention, there is provided a flexible intermediate bulk container, which includes a number of flexible elements sewn to each other along longitudinally extending seams, at least two of the elements being tubular.

Preferably, the container includes a plurality of tubular elements sewn to one another so that each tubular element is secured to two other elements to form a closed configuration. The seams of each element may be parallel.

The container may include four tubular elements sewn to each other at operatively substantially vertical edges of each tubular element. Instead, the container may include eight tubular elements sewn to one another.

Where the container includes eight tubular elements, four of the elements may be diametric in that they may have operatively, substantially vertical seams which are diametrically opposed. Four of the elements may be non-diametric in that they may have operatively, substantially vertical seams which are non-diametrically opposed.

Each diametric element may be sewn to a pair of non-diametric elements.

The non-diametric elements may be located at corners of the container, with longer sides thereof on the outside and shorter sides extending across the corners. The diametric elements may form flat panels between the non-diametric elements.

A floor panel may be sewn to a bottom edge of both sides of each diametric element and the outer, longer sides of each non-diametric element.

The shorter sides of the non-diametric elements may have regions cut out.

Where the container includes four tubular elements, the container may have four side walls, each side wall comprising one of the tubular elements. It will accordingly be appreciated that the longitudinal axis of each element will extend vertically, i.e. perpendicularly to the floor. Each element may be substantially flat so that each side wall has two layers.

At least two of the elements may have substantially the same dimensions. Preferably, the elements are dimensioned so that the container has a rectangular cross-section.

It is to be appreciated that each tubular element has an inner side, an outer side and two opposed longitudinal edges.

Each element may have operatively top and bottom open ends which are sewn closed so that each element has a hem at its top and bottom ends.

A floor panel may be sewn to operatively bottom edges of the elements.

The container may include lifting straps. Each lifting strap may be in the form of a loop of lifting webbing, legs of each loop being sewn between each adjacent pair of said vertical edges. The legs of each loop may extend along substantially the entire length of said vertical edges, to ensure retention of the legs between the edges.

Diagonal panels may be sewn to the inner sides of the elements so that a diagonal panel spans each corner of the container. The inner side of each element may be sewn at two places along its length to form two substantially parallel, spaced folded strips. A longitudinal edge of a diagonal panel may be sewn to each strip. The diagonal panels may have regions cut out.

The container having eight tubular elements may also include lifting straps. These may be located at the corners or "off-the-shoulder". Hence, this container may include four lifting straps. Each lifting strap may be in the form of a loop of lifting webbing, each loop having two legs.

A leg may be sewn to each side of a folded, longitudinally extending strip arranged on the longer side of each non-diametric element.

With the "off-the-shoulder" design, the legs may be sewn to the elements, a leg being proximate each seam joining a non-diametric element to a diametric element. The non-diametric and diametric elements may each be sewn along further seams, the seams being a suitable distance from a folded over line, so that two flaps are provided, each flap being folded to provide a reinforced strip, a leg of lifting webbing being sewn to each flap and an underlying adjacent strip of each element. The legs of the lifting webbing may extend substantially the entire length of the elements. The legs may also be sewn to the floor panel.

If the legs do not extend the full length of the elements, the bottom sections of the flaps below the bottom ends of the legs may also be sewn to their underlying adjacent strips.

A top portion of each element may be folded over.

The invention is now described, by way of examples, with reference to the accompanying drawings.

DETAILED DESCRIPTION OF THE DRAWINGS

Figure 1:
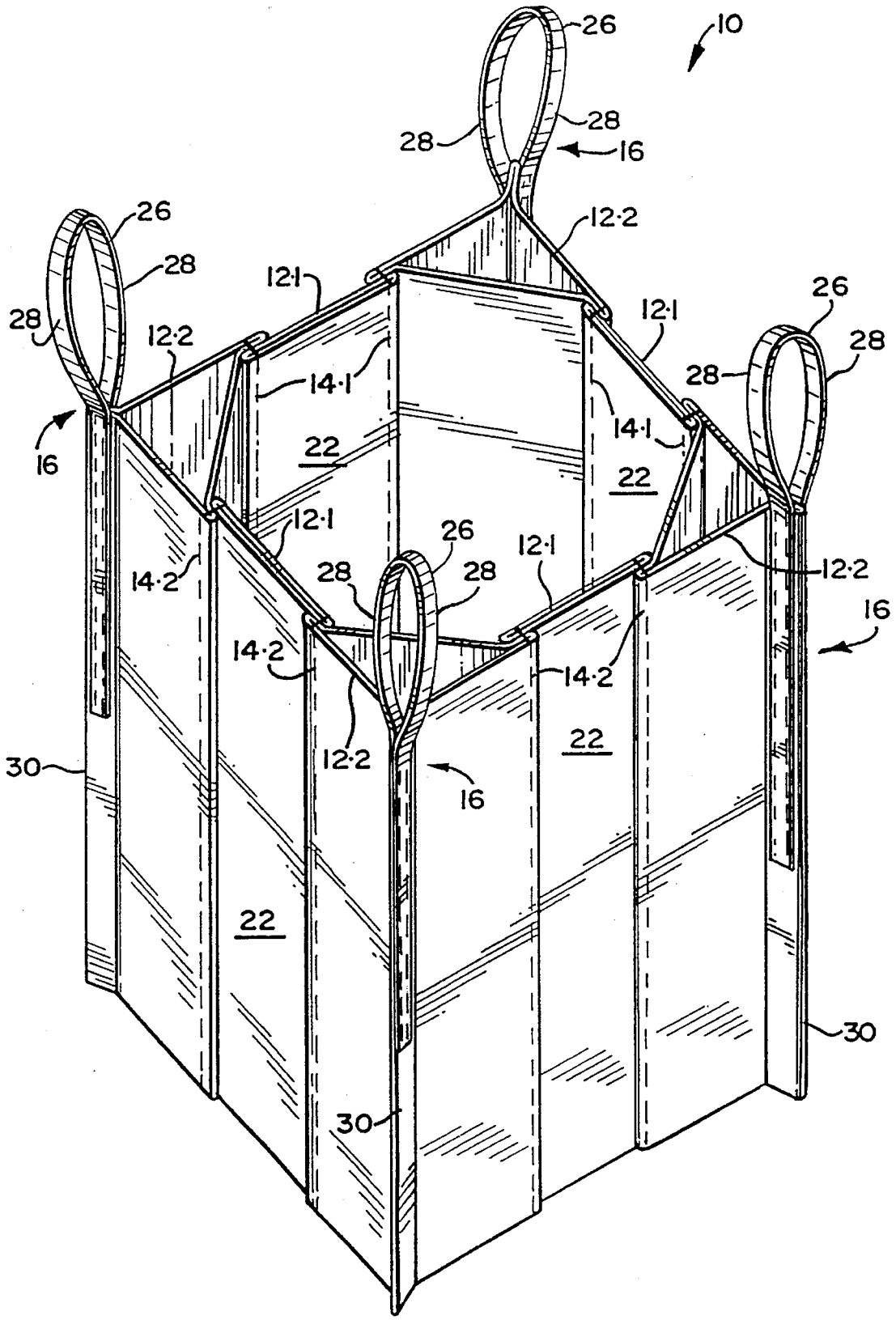
FIG. 1 shows a three dimensional view of a flexible intermediate bulk container in accordance with a first embodiment of the invention.
Figure 2:
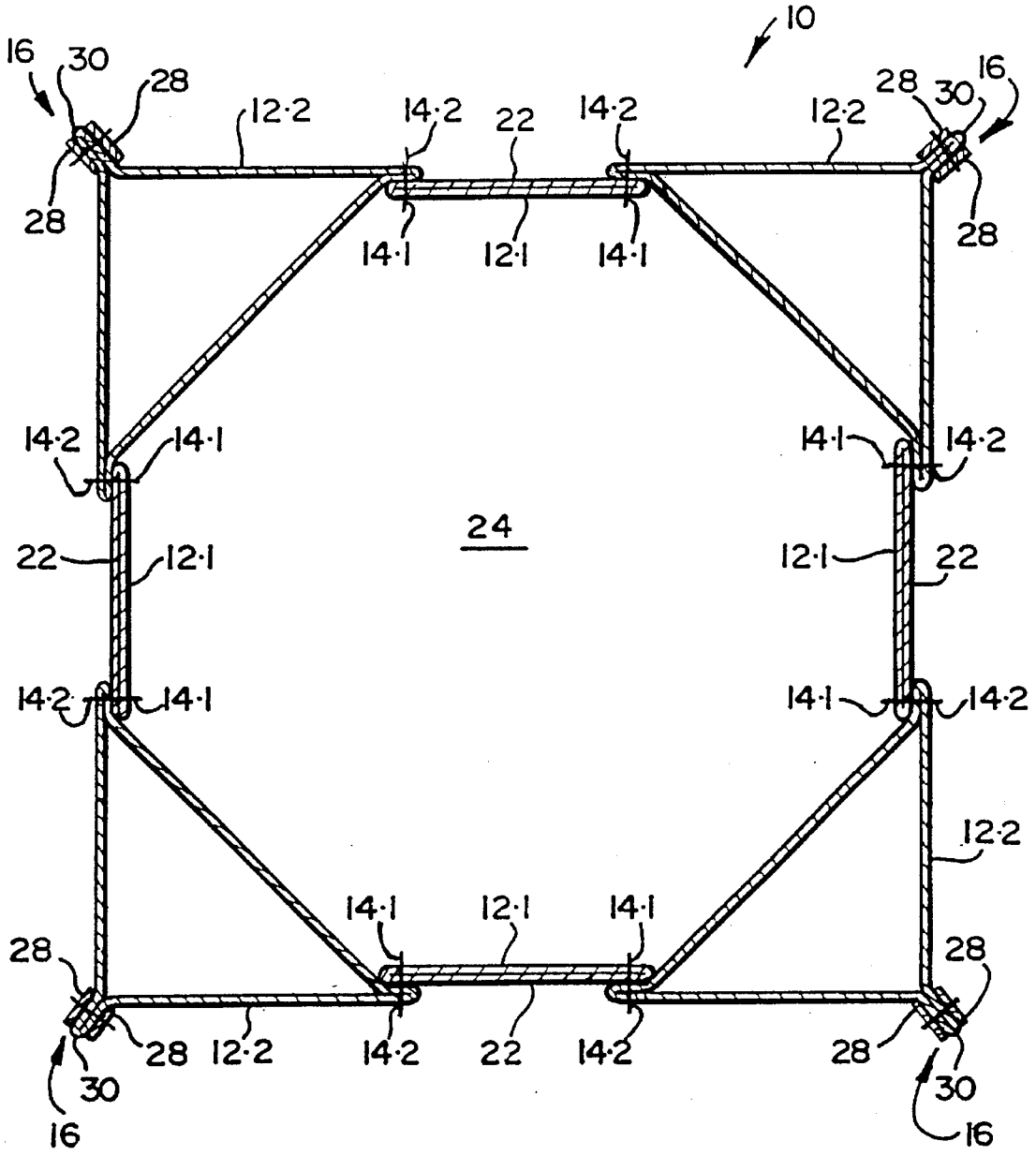
FIG. 2 shows a schematic plan sectioned view of the container of FIG. 1.

In FIGS. 1 and 2, reference numeral 10 generally indicates a flexible intermediate bulk container in accordance with a first embodiment of the invention.

The container 10 includes eight tubular elements 12 that are sewn to one another along seams 14. Each element 12 is secured to another element 12 to form a closed configuration. The seams 14 of each element 12 are parallel. Four of the elements 12.1 are folded flat. Each element 12.1 is secured between a pair of elements 12.2 along seams 14.1. The seams 14.1 are thus diametrically opposed so that the distance between seams 14.1 is the same when measured along both sides of each element 12.1. The remaining four of the elements 12.2 are folded to have three sides, namely an inner side and two, outer sides. The elements 12.2 thus have seams 14.2 that are non-diametrically opposed, the distance between seams 14.2 being greater when taken along the outer sides than when taken along the inner side.

The diametrically sewn elements 12.1 alternate with non-diametrically sewn elements 12.2. Those skilled in the art will appreciate that, in use, the non-diametric elements 12.2 are located at corners 16 of the container 10 with the outer sides defining the corners 16 and with the inner sides extending across the corners 16. The diametric elements 12.1 form flat panels 22 between the non-diametric elements 12.2. It will be appreciated that each corner 16 of the container 10 will be located between outer sides of the non-diametric elements 12.2 intermediate the seams 14.2.

A floor panel 24 is sewn to a bottom edge of both sides of the diametric elements 12.1 and the outer sides of the non-diametric elements 12.2

The elements 12 are woven of a suitable material such as polyester or polypropylene. In order to obtain maximum strength from the tubular elements 12, the tubular elements 12 are woven in a tubular fashion. The result of this is that the tubular elements 12 are, in themselves, seamless and thus lines of weakness within the tubular elements 12 are substantially non-existent.

The container 10 has lifting straps 26. The lifting straps 26 are located at the corners 16. Here, four loops of lifting webbing are provided having legs 28. Each leg 28 is sewn to a side of a folded longitudinally extending strip 30 on the outer sides of the non-diametric elements 12.2 intermediate the seams 14.2. The legs 28 of each strap 26 are sewn to each strip 30. It is to be appreciated that the longitudinally extending strips 30 are formed by folding the tubular elements 12.2 at each corner 16. Each strip 30 is then sandwiched between the legs 28 of each strap 26.

Figure 3:
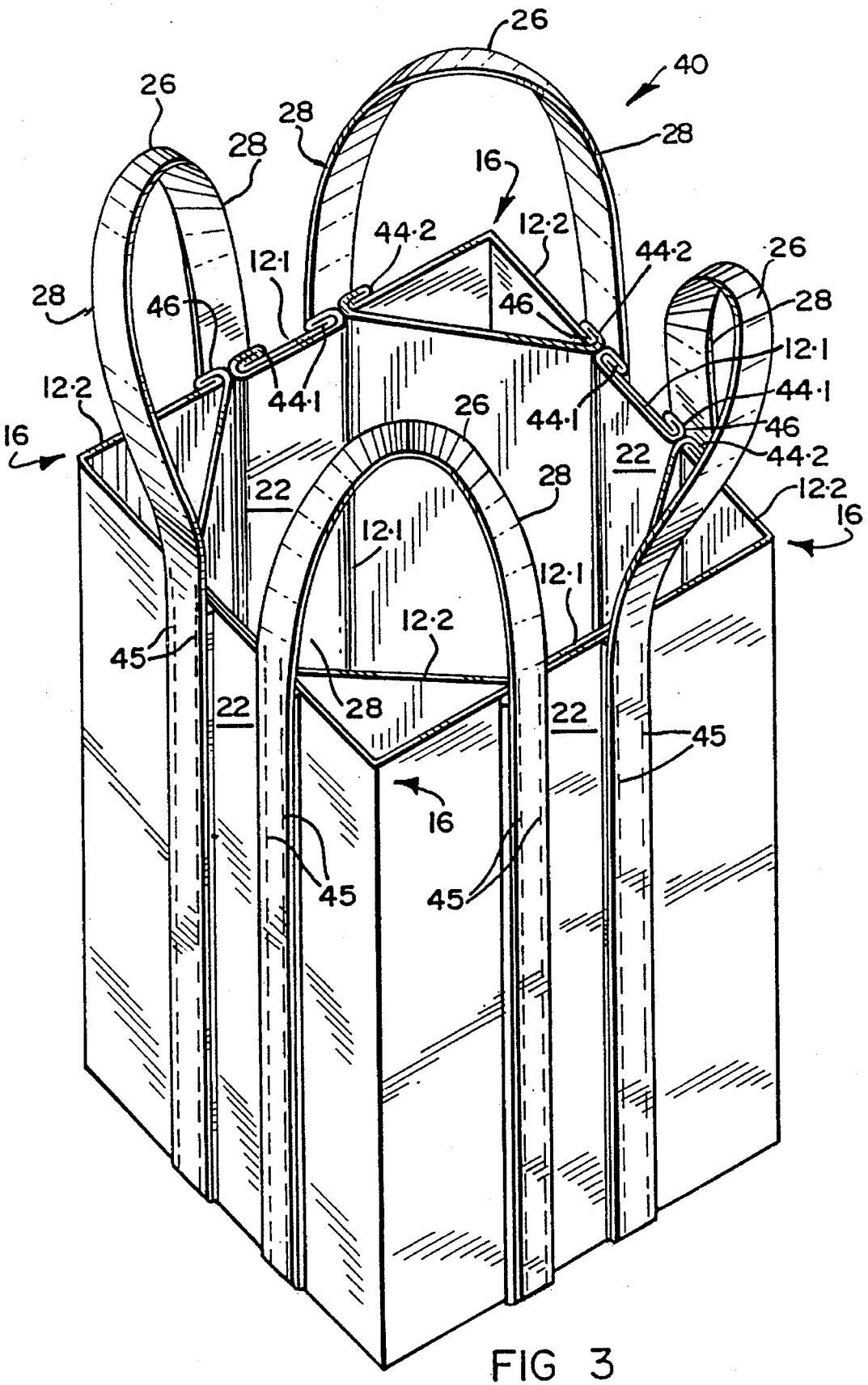
FIG. 3 shows a three dimensional view of a flexible intermediate bulk container in accordance with a second embodiment of the invention.
Figure 4:
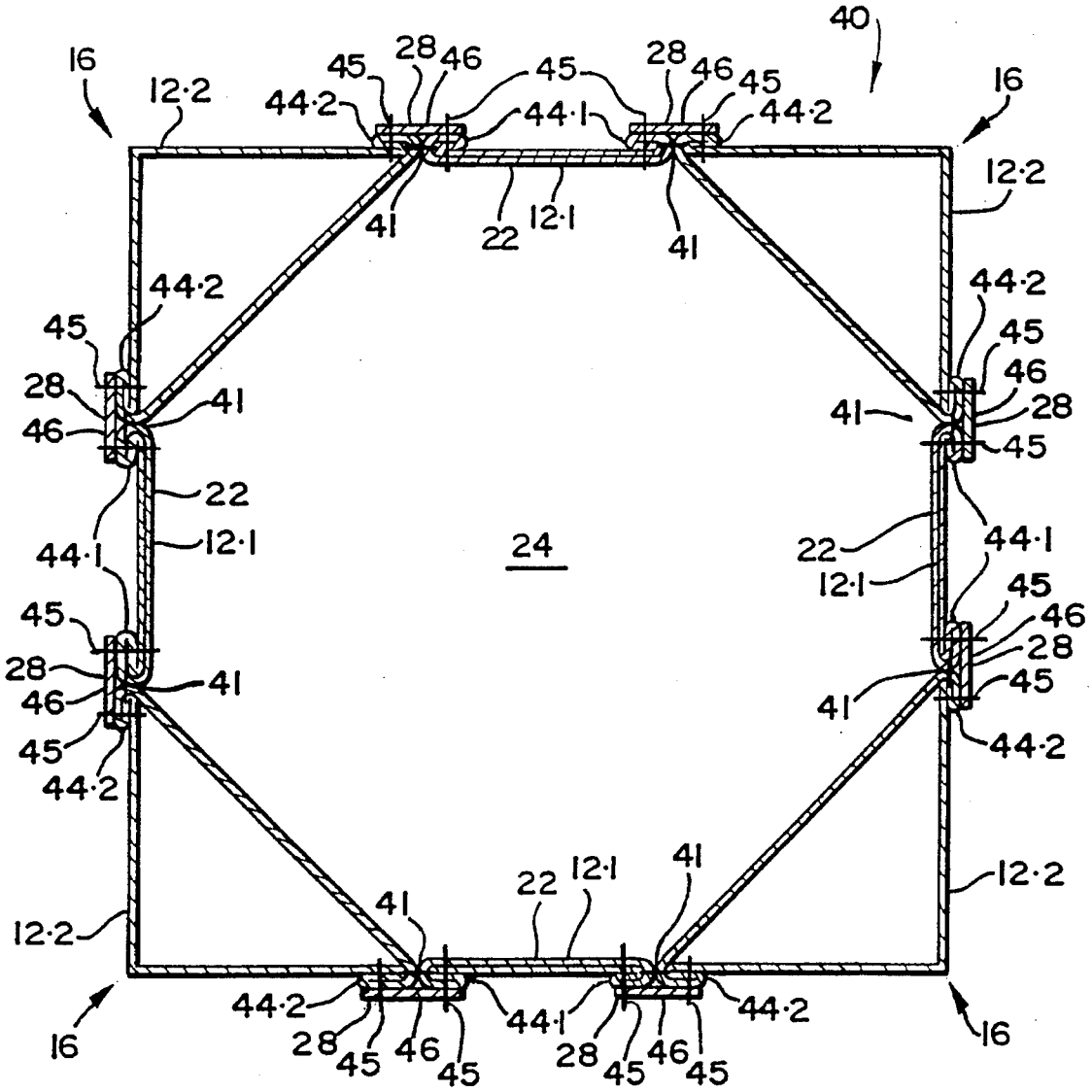
FIG. 4 shows a schematic plan sectioned view of the container of FIG. 3.

In FIGS. 3 and 4, reference numeral 40 generally indicates a container in accordance with a second embodiment of the invention. With reference to FIGS. 1 and 2, like reference numerals refer to like parts unless otherwise specified.

In the container 40, the lifting straps 26 are arranged in what is known as an "off-the-shoulder" design. With the container 40, the diametric and non-diametric elements 12.1 and 12.2 are sewn together along seams 41 a short distance from their ends to provide flaps 44.1 and 44.2. These flaps 44.1, 44.2 are then each folded back to provide a reinforced strip 46. Each leg 28 of each lifting strap 26 is sewn to the flaps 44.1 and 44.2 and the underlying adjacent strips of the elements along parallel seams 45.

With the container 40, the legs 28 of the lifting straps 26 extend the full length of the elements 12 and are sewn into the floor panel 24.

Figure 5:
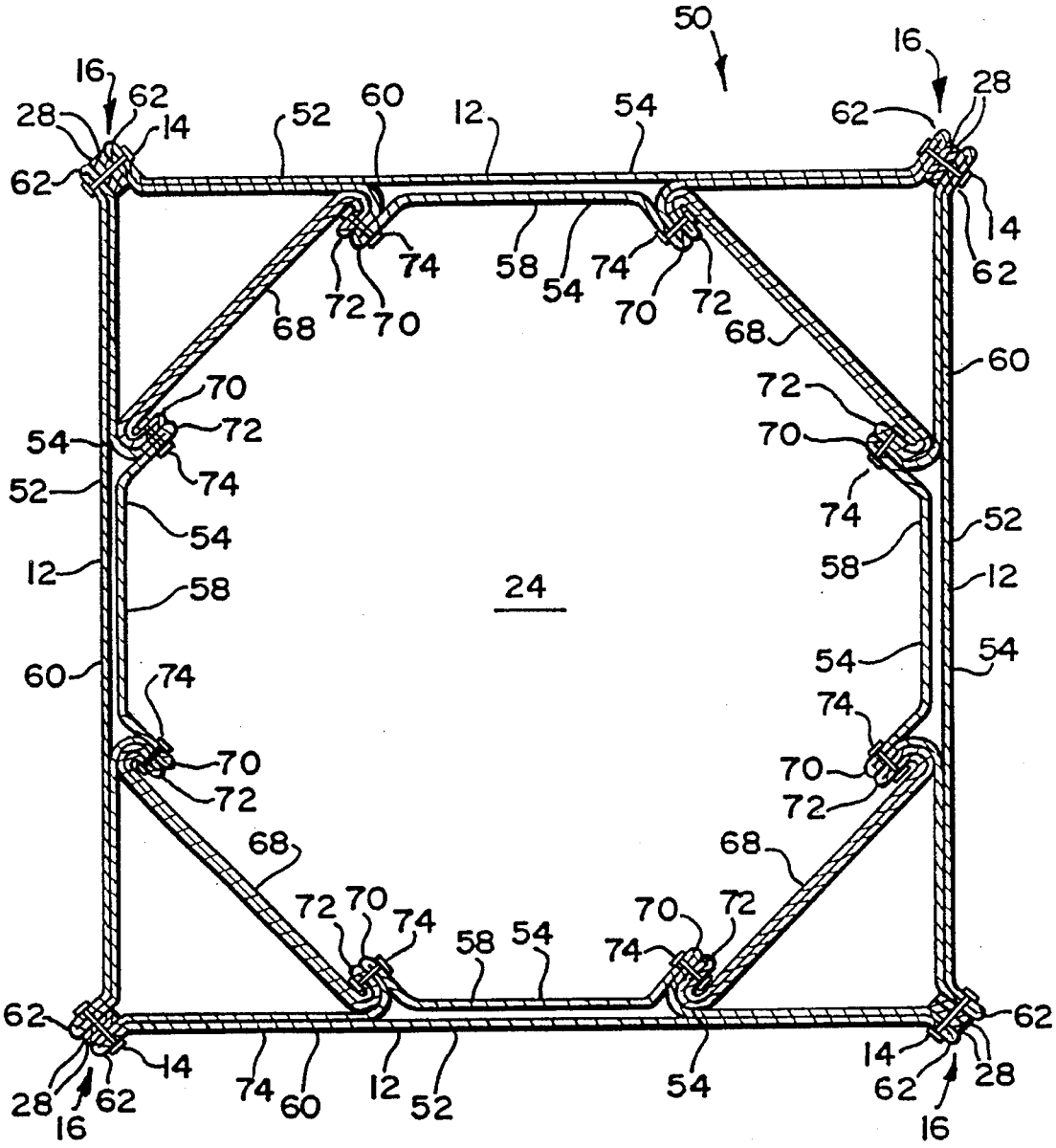
FIG. 5 shows a schematic plan sectioned view of a flexible intermediate bulk container in accordance with a third embodiment of the invention.
Figure 6:
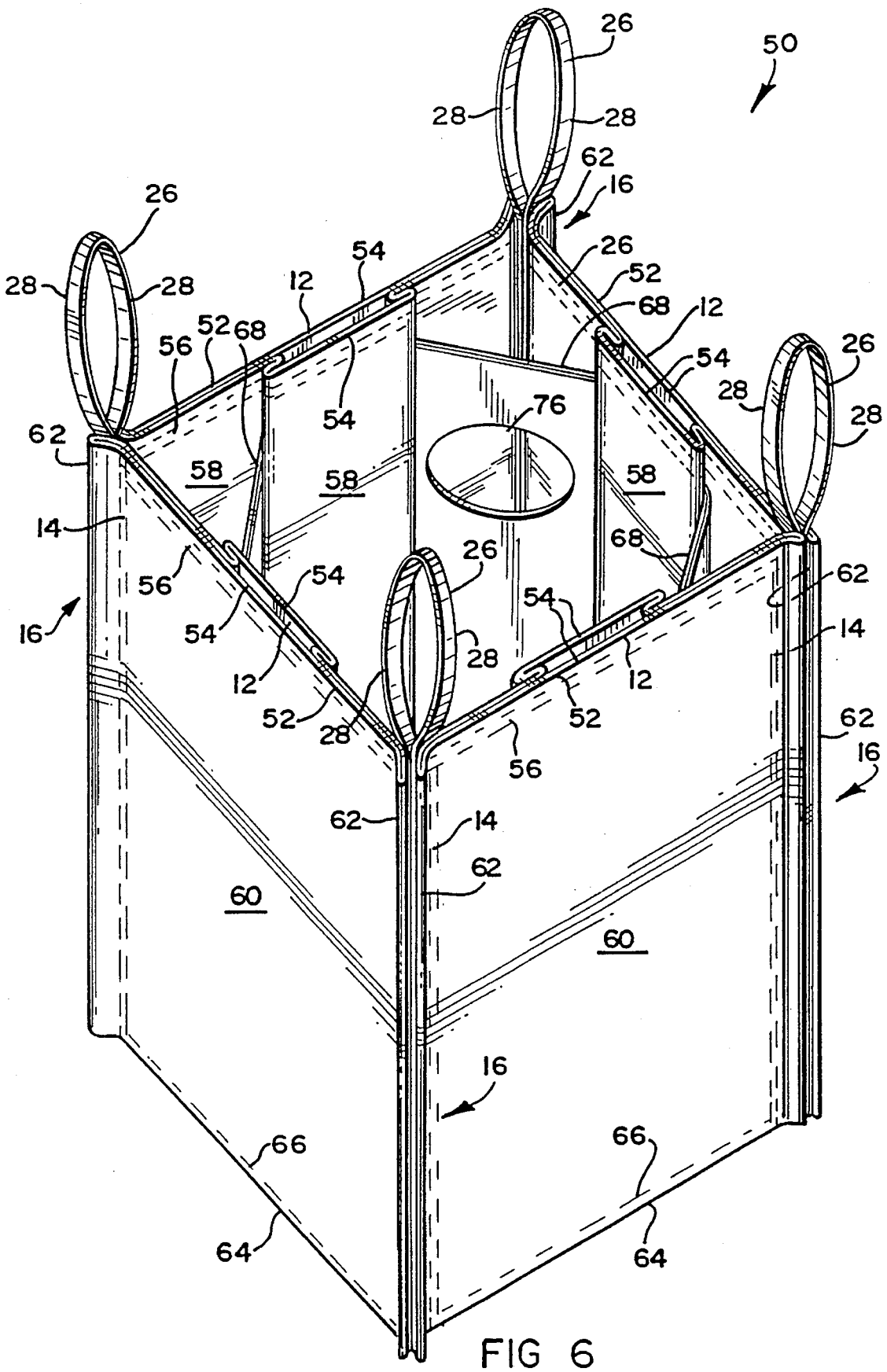
FIG. 6 shows a three dimensional view of the container of FIG. 5.

In FIGS. 5 and 6, reference numeral 50 generally indicates a container in accordance with a third embodiment of the invention. With reference to FIGS. 1 to 4, like reference numerals refer to like parts unless otherwise specified.

The container 50 includes four tubular elements 12 sewn to one another along longitudinally extending seams 14.

The container 50 has four side walls 52. Each side wall 52 comprises one of the tubular elements 12. It will accordingly be appreciated that the longitudinal axis of each element 12 extends vertically, i.e perpendicularly to the floor panel 24. Each element 12 is substantially flat to provide a side wall 52 having two layers 54 of substantially the same size. Each element 12 has top and bottom open ends that are sewn closed along a hem 56.

All the elements 12 have substantially the same dimensions. Thus, the container 50 has a square cross-section.

It is to be appreciated that each tubular element 12 has an inner side 58, an outer side 60 and two opposed longitudinal edges 62. The floor panel 24 is sewn to operatively bottom edges 64 of both sides 58, 60 of the elements 12 along a seam 66.

The container 50 also has lifting straps 26 located at the corners 16 of the container 50. As before, the lifting straps 26 are in the form of four loops of lifting webbing. The legs 28 of each loop are sewn to the container 50. The elements 12 are sewn together at their longitudinal edges 62 and the longitudinal edges 62 are located at the corners 16 of the container 50. Hence, the legs 28 of each lifting strap 26 are sandwiched between the longitudinal edges 62 and secured via the seams 14. Further, the legs 28 extend the length of the container 50 to ensure retention of the legs 28 between the edges 62.

Diagonal panels 68 are sewn to the inner sides 58 of the elements 12 so that a diagonal panel 68 spans each corner 16. The diagonal panels 68 are double-walled. The inner side 58 of each element 12 is folded at two places along its length to form two substantially parallel flaps 70. The diagonal panels 68 are folded at their ends to form complementary flaps 72.

Each flap 70 is sewn to a flap 72 along a longitudinal seam 74. The diagonal panels 68 have regions 76 cut out.

The Applicant believes that the invention provides a container which, as a result of the use of the tubular elements 12, is of high strength and is simple to manufacture.

We claim:

1. A flexible intermediate bulk container, which includes four tubular elements sewn to one another along longitudinally extending seams to form a closed configuration having four side walls, each side wall comprising one of the tubular elements and each pair of adjacent elements defining a corner of the container; and four diagonal panels, a panel being sewn to each pair of adjacent elements so that a diagonal panel spans each corner.

2. The container as claimed in claim 1, in which a floor panel is sewn to operatively bottom edges of the elements.

3. The container as claimed in claim 1, which includes lifting straps.

4. The container as claimed in claim 3, in which each lifting strap is in the form of a loop of lifting webbing, legs of each loop being sewn between each adjacent pair of said vertical edges.

5. The container as claimed in claim 4, in which the legs of each loop extend along substantially the entire length of said vertical edges.

6. A flexible intermediate bulk container which includes four tubular elements sewn to one another along longitudinally extending seams to form a closed configuration having four side walls, each side wall comprising one of the tubular elements and each pair of adjacent elements defining a corner of the container; each element being substantially flat so that each side wall has two layers.

7. The container as claimed in claim 6, in which each element has operatively top and bottom open ends which are sewn closed so that each element has a hem at its top and bottom ends.

8. A flexible intermediate bulk container which includes eight tubular elements sewn to each other along longitudinally extending seams to form a closed configuration;

four of the elements being diametric and having operatively, substantially vertical seams which are diametrically opposed and four of the elements being non-diametric and having operatively, substantially vertical seams which are non-diametrically opposed;

each diametric element being sewn to pair of non-diametric elements, with the non-diametric elements being located at corners of the container, with longer sides thereof on the outside and shorter sides extending across the corners and with the diametric elements forming flat panels between the non-diametric elements;

the non-diametric and diametric elements each being sewn along seams that are each a suitable distance from a folded over line to provide two flaps, each flap being folded over to provide a reinforced strip;

a floor panel sewn to a bottom edge of both sides of each diametric element and the outer, longer sides of each non-diametric element; and four lifting straps, each lifting strap being in the form of a loop of lifting webbing, each loop having two legs, the legs being sewn to the elements so that leg is proximate each seam joining a non-diametric element to a diametric element with the legs being sewn to each flap and an underlying adjacent strip of each element.

9. The container as claimed claim 8 in which the legs of the lifting webbing extend substantially the entire length of the elements.

10. The container as claimed in claim 9, in which the legs are also sewn to the floor panel.

11. The container as claimed in claim 8, in which the shorter sides of the non-diametric elements have regions cut out.

* * * * *